United States Patent [19]

Hansmann et al.

[11] Patent Number: 4,497,256

[45] Date of Patent: Feb. 5, 1985

[54] MOBILE TRACK POSITION CORRECTION MACHINE

[75] Inventors: Johann Hansmann, Klosterneuburg, Austria; Frederick Fawcett, Kings Langley, England

[73] Assignee: Franz Plasser Bahnbaumaschinen Industriegesellschaft m.b.H., Vienna, Austria

[21] Appl. No.: 464,902

[22] Filed: Feb. 8, 1983

[30] Foreign Application Priority Data

Feb. 9, 1982 [AT] Austria ..... 489/82

[51] Int. Cl.[3] ..... E01B 27/02; E01B 27/17; G01F 11/06

[52] U.S. Cl. ..... 104/11; 104/12; 141/94; 222/307

[58] Field of Search ..... 104/7 R, 10, 11, 12; 141/94; 222/306, 307; 239/68, 69, 155

[56] References Cited

U.S. PATENT DOCUMENTS

| | | | |
|---|---|---|---|
| 3,140,018 | 7/1964 | Miller | 222/307 X |
| 3,939,774 | 2/1976 | Theurer et al. | 104/11 |
| 4,257,331 | 3/1981 | Theurer et al. | 104/12 X |
| 4,386,570 | 6/1983 | Waters | 104/11 |
| 4,430,946 | 2/1984 | Theurer et al. | 104/12 X |

FOREIGN PATENT DOCUMENTS

| | | | |
|---|---|---|---|
| 811956 | 8/1951 | Fed. Rep. of Germany . | |
| 2423757 | 12/1979 | France | 222/306 |
| 434096 | 5/1934 | United Kingdom . | |
| 448691 | 6/1936 | United Kingdom | 222/307 |
| 2021180 | 11/1979 | United Kingdom . | |

*Primary Examiner*—David A. Scherbel
*Assistant Examiner*—David F. Hubbuch
*Attorney, Agent, or Firm*—Kurt Kelman

[57] ABSTRACT

A mobile track leveling machine comprises a pneumatic arrangement for introducing additional ballast into a gap between a track bed and a lifted track, which includes a storage container for the ballast, a vertically adjustable pipe arranged to receive ballast from the storage container and to be immersed in the track bed alongside a longitudinal edge of a respective track tie, the pipe having a tapered end for ready penetration into the track bed and a flattened side defining an outlet for the additional ballast facing the longitudinal tie edge. Compressed air is delivered into the pipe for moving the additional ballast therethrough and out of the outlet. A power drive vertically adjusts the pipe, a stop is arranged on the pipe for engagement with the lifted track to limit the immersion depth thereof, and a power-driven metering device is arranged between the storage container and the pipe for delivering a metered amount of the additional ballast from the container to the pipe, the additional ballast amount being metered by the device in response to the lifting stroke to fill the gap between the track bed and the lifted tie.

21 Claims, 16 Drawing Figures

Fig.1
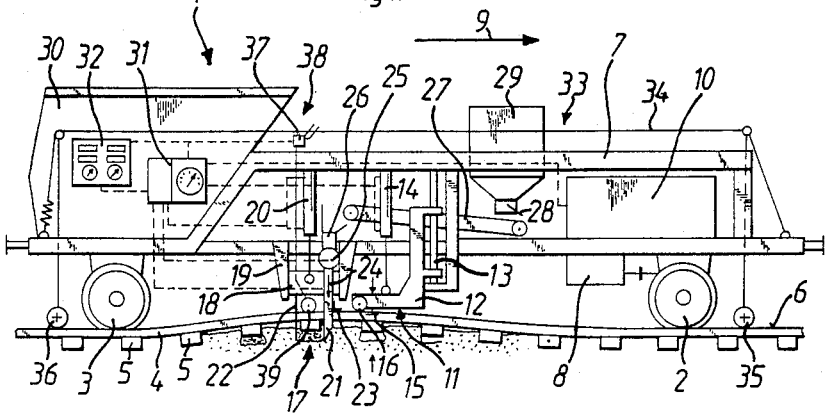
Fig.2
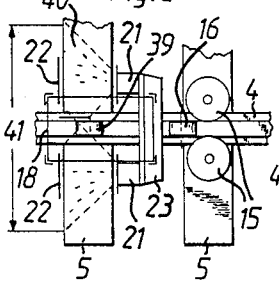
Fig.3
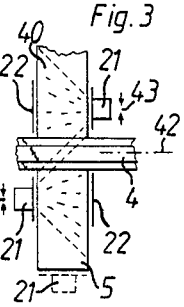
Fig.4
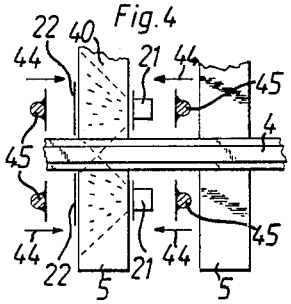
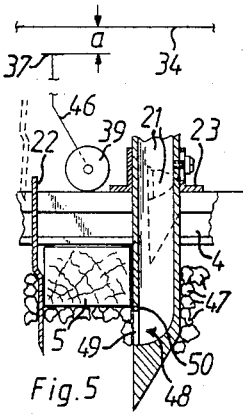
Fig.5
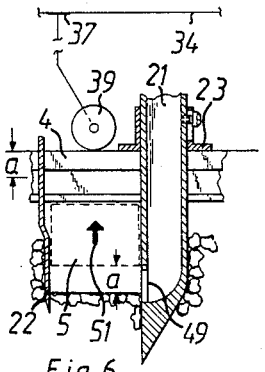
Fig.6
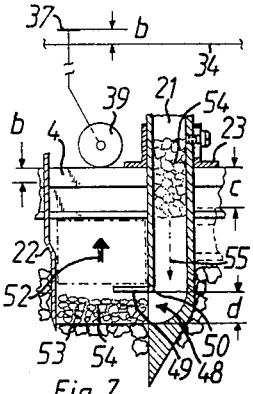
Fig.7

XIV
XIV

MOBILE TRACK POSITION CORRECTION MACHINE

The present invention relates to improvements in a mobile track position correction machine mounted for mobility on a track consisting of two rails fastened to ties supported on a track bed, and more particularly to the type of machine comprising a power-driven track level adjusting device for lifting the track to a desired level whereby a gap is created between the track bed and the ties, a track level reference and measuring system controlling a lifting stroke of the device for lifting the track to the desired level, and a pneumatic arrangement for introducing additional track bed material, such a ballast, gravel or the like, into the gap under the lifted track at the points of intersection between the ties and rails. The pneumatic arrangement includes a storage container for the track bed material, a vertically adjustable pipe arranged to receive track bed material from the storage container and to be immersed in the track bed alongside a longitudinal edge of a respective tie, the pipe having a tapered end for ready penetration into the track bed and a flattened side defining an outlet for the additional track bed material facing the longitudinal tie edge, means for delivering a blast of compressed air into the pipe for moving the additional track bed material therethrough and out of the outlet, and a power drive for vertically adjusting the pipe.

German Pat. No. 811,956, and Aug. 23, 1951, discloses a portable pneumatic tool for blowing particulate track bed material into the gap below a lifted track, the tool carrying a storage container sub-divided by a horizontal sieve through which the classified material falls to a slightly inclined container bottom. Vertical vibrations imparted to the tool direct this track bed material from the inclined container bottom through an annular funnel defined by the tool and an air nozzle coaxially arranged therein. Apart from the fact that the use of this portable hand tool requires extensive and time-consuming preparatory work, such as the erection and operation of a track lifting system for raising the track to the desired level, the relatively narrow annular funnel feeding the particulate track bed material into the tool makes it necessary to limit this material to relatively small particle sizes and since the material is fed through the annular funnel by vibration of the tool, the movement of the material is slow and the operation accordingly very time-consuming. Furthermore, the operator has no control over feeding an amount of track bed material sufficient to fill the gap between the track bed and the lifted track completely. If an excessive amount of material is fed because the air blast is not switched off in time, the narrow passages within the tool will be jammed.

UK patent application No. 2,021,180, published Nov. 28, 1979, discloses a mobile machine with a track lifting device and a pneumatic arrangement for introducing additional ballast into the gap under the lifted track. The arrangement includes a storage container for the ballast and a pipe arranged to receive ballast from the storage container and to be immersed in the track bed alongside a longitudinal edge of a respective track tie, the pipe having a tapered end for ready penetration into the track bed and a flattened side defining an outlet for the ballast facing the longitudinal tie edge. A vibratory feed table is placed below the storage container and an oblique chute delivers the ballast from the feed table into the pipe where it is moved to the outlet by a blast of compressed air. The outlet arrangement at one side of the pipe and the cross section thereof are designed to avoid jamming of the moving ballast in the lower, immersed portion of the pipe. However, no means is provided for properly metering the additional ballast in accordance with local requirements. Therefore, the delivery of ballast is continued until excess ballast emerges from the outlet above the tie and is deposited on the upper tie surface, which is undesirable. Furthermore, the gap below the lifted tie may not be completely and uniformly filled because a pressure equilibrium between the ambient atmosphere and the compressed air pressure within the pipe may be created by the communication of the outlet with the atmosphere, and the effect of the compressed air jet conveying the ballast to the gap below the tie may be insufficient for filling the gap completely with ballast. Furthermore, in this arrangement, too, the particle size of the additional track bed material delivered into the gap is limited to about 20 to 22 mm.

It is the primary object of this invention to overcome the above disadvantages and to provide a mobile track position correction machine of the first-indicated type which assures the maintenance of the desired track level and the pneumatic delivery of the additional track bed material in an accurate amount and properly distributed so that the leveled track will remain stable in the exact, desired position, the pneumatic arrangement furthermore being free of any danger of jamming.

The above and other objects are accomplished according to the invention with such a machine wherein the track level adjusting device is equipped with a power drive for lifting the track to a measurable level above a desired level, and the pneumatic arrangement includes a stop arranged on the pipe for engagement with the lifted track to limit the immersion depth thereof, and a power-driven metering device arranged between the storage container and the pipe for delivering a metered amount of the additional track bed material from the container to the pipe, the additional track bed material amount being metered by the device in response to a parameter corresponding to the desired track level to fill the gap between the track bed and the lifted tie.

This machine for the first time enables additional track bed material to be blown into the gap under the lifted tie without jamming while assuring an exact, measurable amount of the material to be metered in direct response to the extent of the lifting stroke, i.e. the difference between the actual and the desired level of the tie being lifted. Since the track level adjusting device has means for lifting the track to a measurable level above the desired track level, the tie may be sufficiently lifted beyond this desired level to make certain that the entire amount of additional track bed material necessary to fill the gap completely between the tie lifted to the desired level and the track bed may actually be delivered into this gap, even if individual pieces of this material should have a size exceeding the dimension of this gap. Since the volume of this gap is substantially proportional to the lifting stroke of the leveled tie, the required amount of additional track bed material may be precisely predetermined in a very simple manner by taking into account a correction constant dependent on the particle size and character of the additional track bed material used as well as the density of the injected material, which depends on the compressed air pressure. In this manner, the entire corrected track section will have uniform ballast support for the leveled track as well as an even density of the ballast supporting the leveled track.

Furthermore, the mobile track position correction machine of the present invention is much easier to operate than conventional machines of this type because there is no need to watch the pneumatic injection of the ballast under the lifted track, particularly during the final phase, and it operates at a much faster pace since the delivery of the additional track bed material from the storage container to the pneumatic pipe does not proceed in successive stages but the entire amount to be injected is predetermined and metered in a continuous flow of the material from the metering device as it is blown into the gap under the lifted tie, without any danger of jamming of excess material in the pipe. At the same time, the additional track bed material passes in a continuous stream out of the pipe outlet with a high kinetic energy, the pipe outlet being so disposed that this material will enter the gap between the track bed and the lifted tie at the point of intersection between the rail and the tie fastened thereto, and the injected material will spread evenly and completely fill the gap under the pressure of the compressed air blown down the pipe.

The above and other objects, advantages and features of this invention will become more apparent from the following detailed description of certain preferred embodiments thereof, taken in conjunction with the accompanying, partly schematic drawing wherein FIG. 1 is a side elevational view showing a mobile track position correction machine according to one embodiment of the invention;

FIG. 2 is a partial top view showing the pneumatic arrangement of the machine of FIG. 1 in an enlarged scale;

FIG. 3 is a similar view showing another embodiment of the pneumatic arrangement;

FIG. 4 is a like view showing a third embodiment of the pneumatic arrangement;

FIGS. 5, 6 and 7 are enlarged side elevational views, partly in section, showing the pneumatic arrangement of FIGS. 1 and 2 in three different operating phases;

Figures 8, 9, 10, 11, 12, 13, 14, 15, 16:
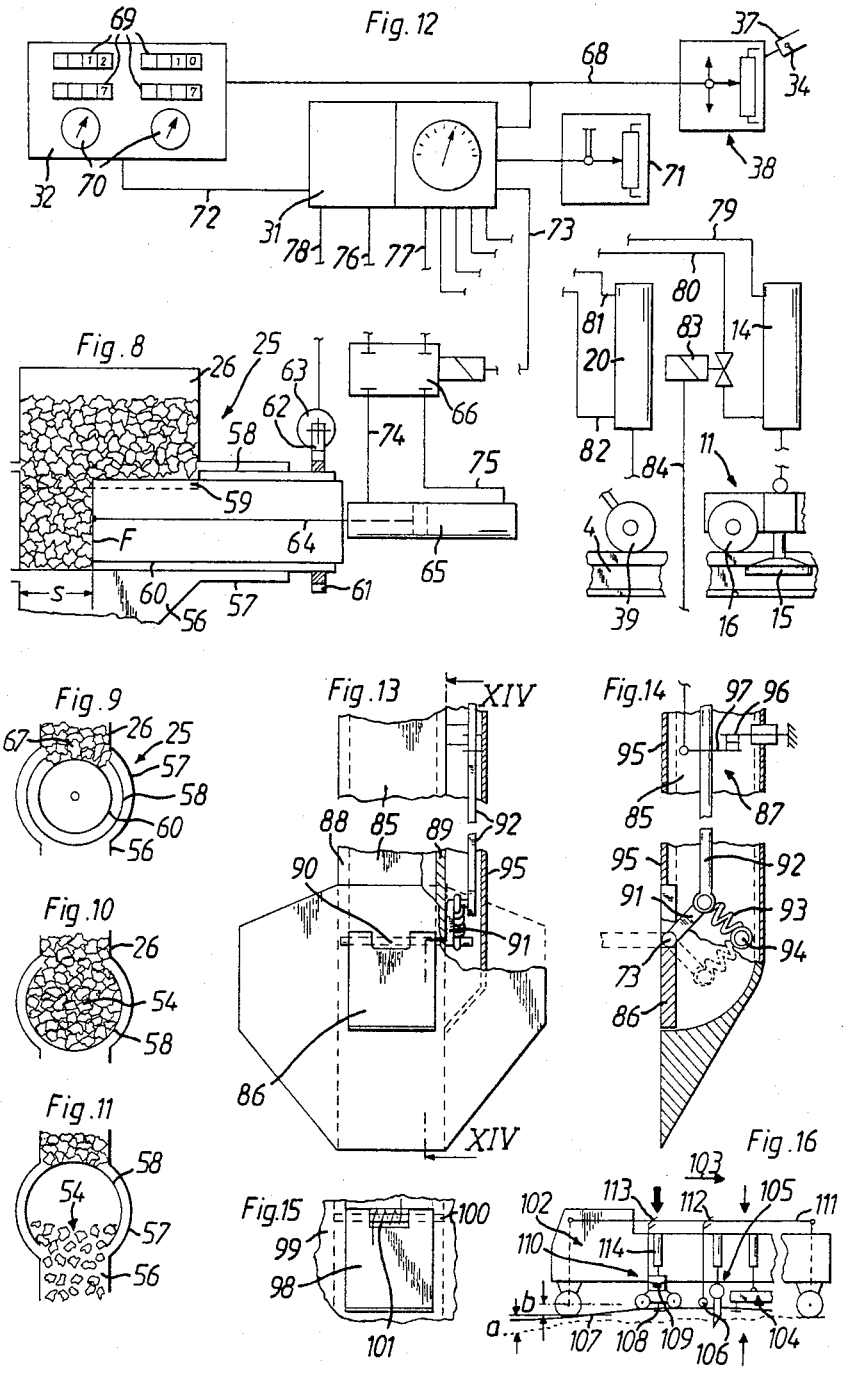

FIG. 8 diagrammatically illustrates the metering device of the pneumatic arrangement;

FIGS. 9, 10 and 11 are transverse sections showing the metering device of FIG. 8 in three different operating phases;

FIG. 12 is a circuit diagram showing the indicating and control devices for the operating elements of the machine of FIG. 1;

FIG. 13 is an enlarged end view, partly in section and seen in the operating direction of the machine, of another embodiment of the pneumatic arrangement;

FIG. 14 is a section along line XIV—XIV of FIG. 13;

FIG. 15 is a partial end view of yet another embodiment of the pneumatic arrangement; and FIG. 16 is a simplified, diagrammatic side view of another embodiment of a mobile machine according to the invention.

Referring now to the drawing and first to FIG. 1, there is shown mobile track position correction machine 1 having frame 7 mounted on undercarriages 2, 3 for mobility on track 6 consisting of two rails 4 fastened to ties 5 supported on a track bed of ballast. Power plant 10 is mounted on machine frame 7 and includes a source of compressed air as well as a source of power for drive 8 connected to the wheels of front undercarriage 2 to move the machine in an operating direction indicated by arrow 9. The machine comprises power-driven track level adjusting device 11 for lifting track 6 to a desired level whereby a gap is created between the track bed and ties 5. The illustrated track level adjusting device comprises carrier frame 12 vertically adjustably mounted on vertical columns 13 affixed to machine frame 7 and linked to the machine frame by double-acting hydraulic jack 14. Pairs of lifting rollers 15, which clamp the head of rails 4 therebetween, and roller 16 pressing against the running surface of the rails are mounted on carrier frame 12. all of this structure being entirely conventional in track leveling machines.

Pneumatic arrangement 17 for introducing additional track bed material, such as ballast, gravel and the like, into the gap under the lifted track at the points of intersection between the ties and rails is arranged on the machine at a location immediately trailing track level adjusting device 11 in the operating direction. The pneumatic arrangement comprises common carrier part 18 vertically adjustably mounted on guides 19 affixed to machine frame 7 and linked thereto by double-acting hydraulic jack 20 enabling the common carrier part of the pneumatic arrangement to be vertically adjusted. Carrier part 18 is substantially centered above each rail 4 and the pneumatic arrangement comprises two pipes 21, 21 straddling each track rail 4 and arranged to receive track bed material from storage container 26 and to be immersed in the track bed alongside a longitudinal edge of a respective tie 5 at the points of intersection between the tie and rails (see FIG. 2). In this embodiment, vertically adjustable, knife-like counter-support 22 is arranged opposite each pipe 21 for immersion in the track bed alongside the opposite longitudinal tie edge at the points of intersection, the counter-supports being spaced from the pipes by a distance substantially corresponding to the width of ties 5 and preferably adjustable to different tie widths. The counter-supports are mounted on common carrier part 18 so that the pipes and counter-supports are vertically adjusted in unison.

With two pneumatic pipes straddling each rail, it is possible to spread the blown-in additional track bed material over adjacent or overlapping ranges of the gap to be filled. Furthermore, since the two pipes are vertically adjusted in unison and connected to the same compressed air and material supply source, their operation is synchronized and the structure and operation of the pneumatic arrangement is greatly simplified. The knife-like counter-supports serve as guide and centering means for the pneumatic pipes in relation to the ties positioned therebetween while, at the same time, serving to limit the range of the gap into which the additional track bed material is injected when the pipes and counter-supports are immersed so that no such material is blown into the adjacent crib.

As best shown in FIGS. 5–7, pipe 21 has a tapered end for ready penetration into track bed 47 and a flattened side defining outlet 48 for the additional track bed material facing the longitudinal tie edge. The pipe is connected to a source of compressed air in power plant 10 for delivering a blast of compressed air into the pipe for moving the additional track bed material coming from storage container 26 through the pipe in the direction of arrow 24 (see FIG. 1) and out of outlet 48.

In accordance with the present invention, stop 23 is arranged on pipe 21 for engagement with the lifted track to limit the immersion depth of the pipe. As shown in FIGS. 5–7, the stop is preferably vertically adjustably affixed to the pipe by means of a screw bolt engaging an elongated slot in the stop. In this manner, the pneumatic arrangement may be so adapted to the prevailing height of the track body that the upper limit of pipe outlet 48 is about at the level of the bottom of tie 4 when the pipe is immersed for operation in the track bed. This assures that the entire pipe outlet is in communication with the gap to be filled so that the additional track bed material may freely flow into the gap. Common power-driven metering device 25 is arranged between storage container 26 and pipes 21 for delivering a metered amount of the additional track bed material from the container to the pipes. The additional track bed material is metered by device 25 in response to the lifting stroke effected by track level adjusting device 11 to fill the gap between the track bed and the lifted tie in a manner to be described in detail hereinafter. Machine frame 7 carries main storage receptacle 29 whose discharge outlet is preferably remote-controlled by closure 28 and opens onto elongated conveyor 27 carrying additional track bed material to storage container 26, as needed.

Operator's cab 30 is mounted at the rear of the machine, as seen in the operating direction, and this cab does not only hold the usual machine operating controls but also central control device 31 and indicating device 32 which, as will be described hereinbelow in connection with FIG. 12, are operatively connected to the essential operating components of the machine.

Machine 1 further comprises track level reference and measuring system 33 controlling the lifting stroke of power-driven track level adjusting device 11 for lifting the track to the desired level. The illustrated and generally conventional system includes tensioned reference wire 34 associated with each track rail 4 and having a front end anchored to rail sensing element 35 which senses the uncorrected track level and a rear end anchored to rail sensing element 36 sensing the corrected track level. Level measuring device 38 includes reference line sensor 37, which may be a rotary pontentiometer, cooperating with reference wire 34 and mounted on rail sensing element 39 sensing the track level in the range of pneumatic arrangement 17. This measuring device emits a signal controlling the lifting stroke of track level adjusting device 11 for lifting the track to the desired level and, temporarily, to a measurable level thereabove during the pneumatic injection of the additional track bed material. Signals indicating the measured track level values are transmitted from measuring device 38 to indicating device 32, where they are recorded in digital or analog form, as well as to control device 31. In accordance with the invention, these control signals are used for controlling metering device 25. It is based on the fact that the amount of additional track bed material pneumatically injected into the gap between the track bed and the lifted tie should be directly proportional to lifting stroke a of each tie, i.e. the difference between the actual and desired track levels measured by device 38 and any correction constant dependent on the material, and that metering device 25, therefore, can determine this amount and hold it ready for delivery to pipe 21 in response to the control signals transmitted by device 38. The corresponding adjustment of metering device 25 is accordingly made either by the operator in cab 30 in accordance with the values indicated on device 32 or automatically by control 31.

In the embodiment of FIG. 2, the two pipes 21 and counter-supports 22 straddling each rail 4 of track 6 form a tool assembly, the two assemblies being arranged symmetrically with respect to a longitudinal vertical plane passing through a center line of the track, the pairs of pipes and counter-supports of each assembly being arranged symmetrically with respect to a longitudinal vertical plane passing through the center of each rail on common carrier part 18. A common stop 23 extending transversely of the rail is arranged on the pair of pipes, the stop being constituted by an angle iron. As indicated in broken lines in FIG. 2, fan-shaped blowing range 40 of each pipe 21 extends roughly over an angle of 90° and the two blowing ranges overlap to assure full coverage of the area under the point of intersection of rail 4 and tie 5. In this manner, the gap along the entire length 41 under the point of intersection is filled with injected additional track bed material.

FIG. 3 shows another embodiment of the pneumatic arrangement for introducing additional track bed material into the gap under the lifted track at the points of intersection between ties 5 and rails 4. In this embodiment, pipe 21 and counter-support 22 form a tool assembly and the two assemblies are arranged to straddle a respective track rail 4 at the points of intersection between rail and tie. The tool assemblies are arranged mirror-reversed with respect to vertical plane 42 passing through respective track rail 4. As schematically shown by arrows 43, vibrating means is operatively connected to pipes 21 for imparting vibrations thereto in a direction extending perpendicularly to the track and transversely thereto to facilitate the immersion of the pipes in the ballast bed. This considerably reduces the power required to lower the pipes into the bed, particularly if the latter is heavily encrusted, helps to speed up the operation and also diminishes the wear on the pipes, especially in their lower sections. The mirror-reversed arrangement shown in FIG. 3 has two particular advantages. On the one hand, the diagonally opposite positioning of injection pipes 21 produces a very favorable distribution of the additional track bed material blown into the gap between the lifted track and the track bed. This is due to the fact that the material is blown into the gap over an angular range of about 90° so that the two effective operating ranges of the two pipes merge with each other, as shown in FIG. 3. On the other hand, the mirror-reversed arrangement greatly facilitates the manufacture of the device.

As shown in FIG. 3 in broken lines, an additional injection pipe 21 may be arranged at respective ends of ties 5, the outlet of the pipe facing inwardly for blowing the additional track bed material substantially transversely to the track in the direction of the point of intersection between the tie and rail. This arrangement is of particular advantage at low points of the track since track correction there requires a relatively large lifting stroke a to raise the tie to the desired track level, thus necessitating the injection of a relatively large amount of additional track bed material under tie 5. Generally, this arrangement avoids the laterally outward displacement of the additional track bed material blown in at a high kinetic energy by pipe 21 located at the longitudinal edge of tie 5 between rail 4 and the end of the tie. Furthermore, it provides an additional delivery of bed material towards the point of intersection between tie 5 and rail 4 where this material is needed to support the leveled track securely.

The pipe and counter-support assembly of FIG. 4 is the same as that of FIG. 2, but this assembly further comprises vibratory tamping tools 45 arranged for reciprocation towards and away from tie 5 under which pipes 21 have blown the additional track bed material. When the generally conventional tamping tools are reciprocated in the directions shown by arrows 44, the additional track bed material is compacted to enhance the solidity of the support for the leveled track. Preferably, the tamping tools will be operated after the injection of the additional track bed material by pipes 21 has been completed and while the track is lowered from the measurable level above the desired track level to the desired track level by the power-driven track level adjusting device.

FIGS. 5 to 7 illustrate three successive operating phases during the injection of a metered amount of the additional track bed material in response to lifting stroke a to fill the gap between the track bed and lifted tie 5. FIG. 5 shows the original, uncorrected level of tie 5 at its point of intersection with track rail 4. As schematically indicated, rail sensing roller 39 carries support rod 46 on which level sensor 37 is mounted and, as is well known in track level reference systems, distance a of this sensor from reference line 34 indicates the required lifting stroke and generates a corresponding level control signal operating power-driven track level adjusting device 11. To bring the pneumatic arrangement into its operating position, hydraulic jack 20 (see FIG. 1) is actuated to lower carrier part 18 of the pneumatic arrangement. Spring means (not shown) yieldingly mount counter-supports 22 and pipes 21 on the carrier part. As indicated in broken lines in FIG. 5, the yieldingly mounted counter-supports and pipes are first brought into a centering position which slightly diverges from tie 5. Immediately before they are immersed into ballast 47 of the track bed, counter-supports 22 and pipes 21 are positioned adjacent the opposite longitudinal edges of tie 5, whereupon they are lowered into ballast 47, optionally while being vibrated in the above-indicated manner, until stop 23 is engaged with the running surface of rail 4. The vertical position of the stop with respect to pipe 21 is adjustable by the illustrated set screw which engages an elongated slot in the pipe wall.

During this first operating phase, lid 49 is in a closing position over outlet 48 of pipe 21. The lid is automatically pivotal upwardly in the gap (whose height has been shown at d in FIG. 7) between the closing position (shown in FIGS. 5 and 6) over the pipe outlet and an upper position (shown in FIG. 7) opening outlet 48 for communication thereof with the gap. The lid has a height exceeding the average lifting stroke a required for lifting a lowest one of the ties to the desired track level, and means for holding the lid over the outlet in the closing position, this lid holding means preferably being a spring means (to be described in greater detail below) connected to the lid and pre-tensioned in the direction of the pivotal closing movement. The lid is pivoted into the upper opening position by the compressed air blown into, and through, the pipe. This arrangement assures that the lid, which is closed during the immersion of the pipe in the ballast, is automatically opened only after the track with the injection pipe engaged thereby has reached the measurable level above the desired track level so that the metered amount of the additional track bed material will have sufficient room for distribution in the gap under the raised tie so that this material will be additionally compacted as the track settles back from the measured level above the desired track level to the desired track level. The arrangement of the automatically effective spring means, for example a coil spring wound about the hinge of the lid, has the advantage that the lid, which will be closed when the pipe is withdrawn from the ballast as the lid touches the underside of the tie, remains securely closed until the pipe is again lowered into the ballast in the above-indicated manner. This avoids the possibility of damage to the tie or to the open lid during the immersion of the pipe in the ballast.

The second operating phase is shown in FIG. 6. In this phase, the track consisting of rail 4 and tie 5 (shown in broken lines) has been lifted by device 11 in the direction of arrow 51 to the desired level determined by reference line 34. Since stop 23 engages rail 4, carrier part 18, on which pipes 21 and counter-supports 22 are mounted, is lifted with the track. As soon as lifting stroke a has been completed, track level sensor 37 transmits a second measuring or control signal to indicating device 32 and control device 31. The difference between the level control signal and the second control signal corresponds to lifting stroke a and determines the amount of additional track bed material to be blown in. This difference, too, is indicated and optionally recorded. At the same time, this second control signal is transmitted to power-driven track level adjusting device 11 to lift the track to a measurable level above the desired track level, this level being measured and monitored by indicating device 32 and control device 31. No compressed air having been introduced into pipe 21, lid 49 remains closed during this second operating phase.

The third operating phase is shown in FIG. 7, at which time the rack has been raised in the direction of arrow 52 by measurable level b above the desired track level determined by reference line 34. Tie 5 has been shown in chain-dotted lines in this figure. This lifting of the track beyond the desired track level is necessary to make certain that all of the additional track bed material metered to fill the gap between the original track bed and the corrected track bed actually has room in the gap at the time it is blown thereinto, at which time the material takes up a greater volume than it eventually has after compaction. The lifting of the track above the desired track level is to be terminated at the point illustrated in FIG. 7, i.e., when the lower edge of lid 49 has reached level 53 of the original track bed under tie 5, thus enabling the lid to be pivoted into the illustrated open position. As has been described, the upward pivoting of lid 49 preferably occurs automatically under the pressure of the compressed air blown into, and through, the pipe, causing the lid to be pivoted against the underside of tie 5 against the bias of the pre-tensioned spring holding it closed. The compressed air will deliver the metered amount of additional track bed material 54 into the gap between original track bed level 53 and the underside of tie 5.

As will be described in detail hereinafter, the means for lifting the track a measurable level above the desired track level comprises a switching element associated with the pipe outlet and transmitting a signal indicating communication between pipe outlet 48 and the gap, i.e., when lid 49 is open. This switching element forms part of a control circuit which transmits the emitted signal to drive 14 of device 11 to stop the drive, i.e. to discontinue lifting of the track, and simultaneously starts delivery of the metered amount of additional track bed material 54 to the pipes. This switching element assures that the track is lifted only so much above the desired level as is required for providing full communication between the pipe outlet and the gap under the tie, i.e. to enable the lid to pivot upwardly, so that the full metered amount of additional track bed material may be blown into the gap. This limitation of the track lifting keeps the flexing of the raised track rails within acceptable limits and also reduces the time required for a full operating cycle. The common indicating device 32 associated with track level adjusting device 11 and with pneumatic arrangement 17, and connected to track level reference and measuring system 33, enables the differential measuring signal between the track level control signal and the second measuring signal to be indicated and optionally recorded in analog or digital form. Extent b of the measurable level above which the track has been lifted depends, on the one hand, on the vertical adjustment of stop 23 on pipe 21 and, on the other hand, on the radial dimension of lid 49 with respect to the pivotal axis 50 of the lid and height d of outlet 48 in the open position of the lid. It is sensed by measuring sensor 37 in relation to reference line 34 to produce a third measuring or control signal transmitted to indicating device 32 and control device 31. Thus, the entire lifting stroke c of the track from its original level is given by the equation $$c=a+b.$$

After the injection of the additional track bed material into the gap below tie 5 has been completed, hydraulic jack 20 for pneumatic arrangement 17 is actuated to lift carrier part 18 of pipes 21 and counter-supports 22. During this upward movement, lids 49 of pipes 21 are automatically closed in the above-indicated manner. In a final phase of the track leveling operation, a downward force is applied to the track to settle it into the track bed until it has reached the desired correct track level. For this purpose, double-acting hydraulic jack 14 of track level adjusting device 11 is actuated to press the track rails down. While this downward force is applied to the track, substantially horizontal vibratory force is applied thereto in a direction extending transversely to the track. This dynamic track stabilization, as is known, will compact the track bed material below tie 5, repositioning the ballast stones until they are located very close to each other so that the volume of injected additional track bed material 54 is so reduced that it corresponds to the volume of the compacted ballast needed for the firm support of the leveled track.

Because this involves a simpler construction, power-driven metering device 25 meters additional track bed material 54 according to volume rather than weight. The volume of material that must be held ready for each injection is derived from the following equation:

$$V=a\times f\times k,$$

wherein a is the lifting stroke, f is the base area of the gap below the tie to be filled and k is the compaction factor of the additional track bed material used, this factor being a constant empirically determined by the ratio of specific volumes of the loosely packed material and the maximally compacted material.

FIGS. 8 to 11 more fully illustrated the structure and operation of power-driven metering device 25 for delivering a metered amount of additional track bed material 54 from storage container 26 to pipe 21, the additional track bed material amount being metered by the device in response to lifting stroke a to fill the gap between the track bed and the lifted tie, this device operating on the principle of measuring the volume of the material and holding it in interim storage before it is delivered by a blast of compressed air to and through the pipe. The illustrated metering device comprises substantially horizontal metering cylinder 57 defining an upper inlet opening in communication with storage container 26 and a lower outlet opening in communication with pipe 21 through chute 56 leading to the pipe. Tubular closure part 58 is rotatably mounted in metering cylinder 57 and defines cut-out 59 corresponding to the cylinder openings. Metering piston 60 is axially movably mounted in the closure part. Such a metering device structure responsive to the lifting stroke is very simple and operates very dependably. It enables a stepless control of the stored material to be delivered and a dependable filling and emptying of the metering cylinder. As shown in FIG. 8, pinion 61 is affixed to the outer end of tubular closure part 58 and this pinion is engaged by rack 62 connected to the piston of hydraulic jack 63 arranged perpendicularly to the axis of tubular closure part 58, rack-and-pinion gear 61, 62 enabling the closure part to be rotated about its axis upon actuation of jack 63. Metering piston 60 is connected to piston rod 64 of double-acting hydraulic jack 65 arranged coaxially with the metering piston and the flow of hydraulic fluid to the respective cylinder chambers of jack 65 is controlled by proportional solenoid valve 66. FIG. 9 shows the initial position of the metering device, wherein metering piston 60 has been moved axially into metering cylinder 57 to the limiting abutment and cut-out 59 in tubular closure part 58 is in communication with storage container 26. As soon as track level reference and measuring system 33 has determined required lifting stroke a for lifting the track to the desired level, metering device 25 is brought into the position shown in FIGS. 8 and 10, in which additional track bed material 54 is delivered from storage container 26 into pipe 21. For this purpose, metering piston 60 is axially moved out of the initial position by jack 65 by distance s so that the material falls into the space of metering cylinder 57 no longer occupied by the metering piston. To enable the required amount of the material to enter the metering cylinder, the volume of the cylinder space no longer occupied by the metering piston, i.e. the product of length s of the piston path and piston face area F, must correspond to volume V determined by the above equation. This produces the determination of length s of the piston path on the basis of the following relationships:

$$s\times F=V=a\times k\times f$$

$$s=a(k\times f/F)=a\times K,$$

wherein K is a constant Proportional factor dependent solely on the track bed material and fixed geometric parameters.

Therefore, metering device 25 may be fully automatically controlled merely by establishing a desired proportion between length s of the axial piston path and lifting stroke a of the track by a suitable computer program.

FIG. 11 shows the emptying or delivery position of metering device 25. In this position, rack-and-pinion gear 61, 62 has been turned by jack 63 to rotate tubular closing part 58 so that cut-out 59 thereof is moved 180° to communicate with chute 56 leading to the injection pipe. In this manner, additional track bed material 54 stored in metering cylinder 57 is delivered into pipe 21 (see FIG. 7) which simultaneously receives a blast of compressed air.

FIGS. 12 shows a simplified and schematic diagram of the above-described common control device associated with the track level adjusting device and with the pneumatic arrangement of this invention, and which is connected to the track level reference and measuring system and wherein the stroke of the metering piston is adjustable in proportion to the lifting stroke by the common control device. Track level reference and measuring system 33, which monitors the track level and controls the lifting stroke of power-driven track level adjusting device 11 for lifting the track to a desired level, comprises level measuring sensor 37 constituted by a fork-shaped pivotal arm arranged for engagement with reference line 34 of track level reference system 33 of the machine. It is connected to control device 31 and indicating device 32 by control circuit line 68 which transmits control signals from system 33 to these devices, such track level reference and control systems being entirely conventional and well known to those skilled in the art. Indicating device 32 has at least four indicator fields 69 for the digital indication of lifting strokes a required to raise the left and right rails of the track to the desired level and additional lifting strokes b required to raise the rails to the measurable level thereabove. The indicating device further comprises two analog indicator instruments 70 for continuously monitoring the track raising operation as it proceeds. Control circuit line 72 connects indicating device 32 to one input of control device 31 while control signal transmitter 71 is connected to another input of the control device to transmit thereto a control signal pre-selecting a desired track level. Control device 31 is connected by hydraulic fluid conduits 76, 77 to proportional solenoid valve 66, valve 66 controlling the flow of hydraulic fluid through conduits 74, 75 to the chambers of hydraulic jack 65 actuating metering device 25. Control circuit line 73 connects an output of control device 31 to the magnetic system of the solenoid valve. Another hydraulic fluid conduit 78 connects drive 63 of closure part 58 of metering device 25 to control device 31. Furthermore, the chambers of hydraulic lifting drives 14 and 20 of track level adjusting device 11 and pneumatic arrangement 17, respectively, are also connected to control device 31 by hydraulic fluid conduits 79, 80 and 81, 82, respectively. Solenoid shut-off valve 83 is mounted in conduit 80 leading to the lower chamber of jack 14 and the magnetic system of valve 83 is connected to control circuit line 84 to a switching element associated with the pipe outlet, for example a movable contact of a switch illustrated in detail in FIGS. 13 and 14.

The control circuit schematically shown in FIG. 12 operates in the following manner:

Before the track level operation starts, control signal transmitter 71 is set to transmit a control signal corresponding to the desired track level. Subsequently, the machine is advanced to a position in which a first tie of the track section to be corrected is to be lifted and additional track bed material is to be injected under the lifted tie. After the pneumatic arrangement including the injection pipe and counter-support have been properly centered with respect to the tie, control device 31 will be operated to cause hydraulic fluid to flow through conduit 81 into the upper chamber of drive 20, thus lowering pneumatic arrangement 18 and immersing pipe 21 and counter-support 22 in the ballast where they assume the position shown in FIG. 5. At the same time, circuit control line 68 transmits a track level monitoring signal from track level reference system 33 to indicating device 32 and control device 31. The pressure is now relieved in hydraulic fluid conduits 81, 82 and opened shut-off valve 83 in conduit 80 permits flow of hydraulic fluid into the lower chamber of jack 14 to lift track level adjusting device 11, thereby raising the track and pneumatic arrangement 17 with it to the desired level, as indicated in FIG. 6. While the track is being raised, the track level indicating signal transmitted by system 33 is continuously compared in control device 31 with the pre-set control signal transmitted to the control device from control signal transmitter 71. At the moment when the signal transmitted by track level reference system 33 and by control signal transmitter 71 have the same value, the indicated difference between the original level of the track and the desired track level which has now been reached and which corresponds to lifting stroke a is indicated at device 32 and control device 31 simultaneously transmits a voltage proportional thereto through control circuit line 73 to valve 66, causing hydraulic fluid to flow through conduit 74 into one of the chambers of drive 65 until metering piston 60 is axially moved by distance s to permit additional track bed material 54 to be stored in metering cylinder 57. The still connected track level adjusting device 11 will lift the track with pneumatic arrangement 17 to a measurable level above the desired track level into the position shown in FIG. 7 when the lid over the pipe outlet is automatically opened by the air blast delivered into the pipe. At this moment, the switching element associated with the pipe outlet interrupts the flow of current through the line 84 and shut-off valve 83 in hydraulic fluid conduit 80 is closed to hold track level adjusting device 11 in position. At the same time, a signal corresponding to value b of the lifting stroke for raising the track above the desired level is transmitted from system 33 to indicating device 32 and control device 31 which actuates drive 63 by delivering hydraulic fluid through conduit 78 to the drive and turns closure part 58 into the position shown in FIG. 11 to start the injection of additional track bed material 54. After the gap between the original track bed and the lifted tie has been filled with the additional track bed material, drive 20 is actuated to lift pneumatic arrangement 17 out of the ballast, the automatically closing lid over the pipe outlet causing the switching element to close the circuit to shut-off valve 83 whereby the valve is opened and blocking of drive 14 is discontinued. Hydraulic fluid is now delivered to the upper chamber of drive 14 through conduit 79 to lower the track by measurable distance b to the desired level. As previously mentioned, the hydraulic downward pressure on the track rails is combined with a horizontally extending, transverse vibration to stabilize the track dynamically at the desired track level at which it has been fixed by the injected additional track bed material. This final desired track level is ascertained by comparing the signal from system 33 with that of transmitter 71. When they are equal, control device 31 will discontinue the flow of hydraulic fluid through conduits 79, 80 so that no pressure is exerted on drive 14, at which point the machine is ready for advancement to the next tie to be lifted.

This arrangement of the means for lifting the track to a measurable level above the desired level, which comprises a switching element associated with the pipe outlet and transmitting a signal indicating communication between the outlet and the gap, automatically defines this level and makes it measurable simply by switching off the power-driven track level adjusting device at the moment the communication between the outlet and the gap is indicated. This requires no more than a switch and a shut-off valve actuated thereby.

FIGS. 13 and 14 show an embodiment of additional track bed material injection pipe 85 with pivotal lid 86, FIG. 14 showing the lid in full lines in its closed position while the open position thereof is indicated in broken lines. Switching element 87 is associated with the pipe outlet and transmits a signal indicating the open lid position, i.e. communication between the outlet and the gap under the tie. This switching element is connected by control circuit line 84 to control the operation of jack 14 actuating track level adjusting device 11. In this embodiment, pivot 90 of lid 86 has its opposite ends journaled in lateral walls 88 and 89 of pipe 85, and one pivot end carries crank arm 91, upwardly extending rod 92 and one end of coil spring 93 pre-tensioned in the direction of the pivotal closing movement of lid 86 being linked to the crank arm. The other coil spring end is pivotally supported on bolt 94. Crank arm 91, rod 92 and spring 93 are arranged in protective housing 95 affixed to lateral wall 89, for instance by welding. The predetermined bias built into coil spring 93 causes crank arm 91 and, therefore, lid 86 to be held in the closed or open position. Switching element 87 is arranged in the upper part of injection pipe 85, which is not immersed in the ballast, and is comprised of fixed contact 96 insulatingly arranged on protective housing 95 and movable contact 97 connected with rod 92. In the illustrated circuit arrangement, switching element 87 closes the control circuit in the closed position of lid 86 and opens it in the open lid position. Optionally, the pivotal position of the lid may be adjusted by manipulating the upper end of rod 92.

FIG. 15 illustrates a particularly simple embodiment of a spring-biased pivotal lid 98 for closing the outlet of partially shown injection pipe 99. The pivotal lid is held closed by pre-tensioned coil spring 101 wound about hinge 100 of the lid, one end of the coil spring abutting lid 98 and the other end thereof abutting the pipe.

FIG. 16 schematically shows another embodiment of a track correction machine 102 running on track 107 on undercarriages in an operating direction indicated by arrow 103. The machine frame carries power-driven track level adjusting device 104, pneumatic arrangement 105 trailing the track level adjusting device in the operating direction for blowing additional track bed material into the gap between the original track bed and the raised tie, track level sensor 106 associated with the pneumatic arrangement and dynamic track stabilizing device 110 trailing the pneumatic arrangement in this direction. The generally conventional dynamic track stabilizing device runs on the track rails on its own wheels and comprises clamping rollers 108 gripping the track rails and vibration imparting device 109 generating horizontal, transversely extending vibratory forces as well as hydraulic drive 114 arranged to subject track 107 to a vertical load and substantially horizontal transverse vibrations whereby the track is lowered to a predetermined level below the desired level. This arrangement enables the leveled track to be settled to a final position measurably below the desired track level whereby the additional track bed material blown into the gap below the raised tie is further compacted, different settled levels of the track at different ties are avoided and the position of the corrected track is stabilized. In other respects, this embodiment operates in the same manner as hereinabove described, pneumatic arrangement 105 being simplified by omission of the counter-supports cooperation with the injection pipes. The heavy arrow indicates the direction of the vertical load to which drive 114 subjects track 107. As in the embodiment of FIG. 1, the track level reference system comprises respective reference lines 111 associated with each track rail and cooperating with sensors 112 and 113 transmitting track level control signals to track level adjusting device 104 and dynamic track stabilizing device 110, respectively. In this embodiment, device 104 lifts the track to a measurable level above the desired track level (indicated in chain-dotted lines), the additional track bed material is injected and the track stabilizing device lowers the track by measurable distance b under the control of sensor 113 to the desired level indicated in full lines behind machine 102. When sensor 113 transmits the level control signal, operation of drive 114 and vibrating device 109 is discontinued. The original, uncorrected track position is indicated in broken lines and a shows the lifting stroke required to lift the track to the desired level.

While the invention has been described and illustrated in connection with certain now preferred embodiments, it will be understood that many modifications and variations may occur to those skilled in the art without departing from the spirit and scope of this invention as defined in the appended claims. For example, while the metering of the additional track bed material has been described and illustrated on the basis of volume, it could be accomplished on the basis of weight if the metering device were equipped with a suitable scale for weighing the material. Also, while reference wires have been shown as reference lines, laser reference systems cooperating with light or temperature-sensitive reference lines could be used.

What is claimed is:

1. A mobile track position correction machine mounted for mobility on a track consisting of two rails fastened to ties supported on a track bed, comprising (a) a track level adjusting device for lifting the track whereby a gap is created between the track bed and the ties at a respective point of intersection between a respective rail and a respective tie, (b) a power drive for imparting a lifting stroke to the track level adjusting device, (c) a track level reference and measuring system controlling the lifting stroke of the device, the system including (1) a track level measuring device capable of delivering parameters corresponding to the measured track level, a desired track level, and a measurable track level above the desired track level, and (d) pneumatic arrangement for introducing additional track bed material into the gap, the pneumatic arrangement including (1) a storage container for the track bed material, (2) a vertically adjustable pipe arranged to receive track bed material from the storage container and to be immersed in the track bed alongside a longitudinal edge of the respective tie, the pipe having a tapered end for ready penetration into the track bed and a flattened side defining an outlet for the additional track bed material facing the longitudinal tie edge, (3) means for delivering a blast of compressed air into the pipe for moving the additional track bed material therethrough and out of the outlet, (4) a power drive for vertically adjusting the pipe, (5) a stop arranged on the pipe for engagement with the respective rail, (6) a power-driven metering device arranged between the storage container and the pipe for delivering a metered amount of the additional track bed material from the container to the pipe, the additional track bed material amount being metered by the metering device in response to the parameter corresponding to the desired track level to fill the gap between the track bed and the lifted tie.

2. The mobile track position correction machine of claim 1, wherein the track level measuring device comprises a switching element associated with the pipe outlet and transmitting a signal indicating communication between the outlet and the gap to the track level measuring device.

3. The mobile track position correction machine of claim 1, further comprising a common indicating device associated with the track level adjusting device and with the pneumatic arrangement, the common indicating device being electrically connected to the track level measuring device.

4. The mobile track position correction machine of claim 1, further comprising a common control device associated with the track level adjusting device and with the pneumatic arrangement, the common control device being electrically connected to the track level measuring device.

5. The mobile track position correction machine of claim 1, wherein the stop on the pipe is arranged vertically adjustably on the pipe and for common movement with the track engaged thereby to the measurable level above the desired level.

6. The mobile track position correction machine of claim 1, further comprising a lid automatically pivotally upwardly in the gap from a closing position over the outlet to an upper position opening the outlet for communication thereof with the gap, the lid having a height exceeding the average lifting stroke required for lifting a lowest one of the ties to the desired track level, and means for holding the lid over the outlet in the closing position.

7. The mobile track position correction machine of claim 6, comprising a switching element associated with the lid and transmitting a signal indicating the pivotal position of the lid.

8. The mobile track position correction machine of claim 7, wherein the switching element has an electrical contact responsive to the opening pivotal movement of the lid, and the power drive of the track level adjusting device is connected to the electrical contact whereby operation of the drive is discontinued in response to the opening pivotal movement of the lid.

9. The mobile track position correction machine of claim 6, the lid being pivoted in response to a predetermined excess pressure of the compressed air in the pipe.

10. The mobile track position correction machine of claim 6, wherein the lid holding means is a spring means connected to the lid and pre-tensioned in the direction of the pivotal closing movement thereof.

11. The mobile track position correction machine of claim 10, wherein the lid is pivotal about a hinge axle and the spring means is a coil spring wound about the axle.

12. The mobile track position correction machine of claim 1, wherein the pneumatic arrangement comprises two of said pipes straddling each one of the track rails and arranged for immersion in the track bed alongside the longitudinal tie edge at said points of intersection.

13. The mobile track position correction machine of claim 1, wherein the pneumatic arrangement further includes a respective one of additional pipes arranged for immersion in the track bed alongside a respective one of the ends of the ties at said points of intersection and also arranged to receive the track bed material from the storage container, the additional pipes also having a tapered end for ready penetration into the track bed and a flattened side defining an outlet for the additional track bed material facing the tie ends.

14. The mobile track position correction machine of claim 1, further comprising a vertically adjustable, knife-like counter-support arranged opposite the pipe for immersion in the track bed alongside the opposite longitudinal tie edge at said points of intersection, the counter-support facing the pipe outlet.

15. The mobile track position correction machine of claim 14, wherein the counter-support is connected to the power drive of the pipe for common vertical adjustment therewith.

16. The mobile track position correction machine of claim 15, further comprising a common vertically adjustable carrier part for the counter-support and the pipe.

17. The mobile track position correction machine of claim 15, further comprising vibrating means for imparting vibrations to the pipe in a direction extending perpendicularly to the track.

18. The mobile track position correction machine of claim 15, wherein the pipe and counter-support form a tool assembly, two of said assemblies being arranged to straddle a respective one of the track rails at said points of intersection and the tool assemblies being arranged mirror-reversed with respect to a vertical plane passing through the respective track rail.

19. The mobile track position correction machine of claim 1, wherein the metering device comprises a substantially horizontal metering cylinder, the cylinder defining an upper inlet opening in communication with the storage container and a lower outlet opening in communication with the pipe, a tubular closure part rotatably mounted in the metering cylinder, the closure part defining a cut-out corresponding to the cylinder openings, and a metering piston axially movably mounted in the closure part.

20. The mobile track position correction machine of claim 19, further comprising a common control device associated with the track level adjusting device and with the pneumatic arrangement, the common control device being electrically connected to the track level reference and measuring system, and the stroke of the metering piston being adjustable by the common control device in proportion to the lifting stroke.

21. The mobile track position correction machine of claim 1, wherein the machine comprises a frame running on the track on undercarriages in an operating direction, and further comprising a dynamic track stabilizing device trailing the pipe in said direction, the stabilizing device being arranged to subject the track to a vertical load and substantially horizontal transverse vibrations whereby the track is lowered to a predetermined level below the desired level.

* * * * *